US006444276B2

(12) United States Patent
Bertholdt

(10) Patent No.: US 6,444,276 B2
(45) Date of Patent: Sep. 3, 2002

(54) METHOD FOR DECONTAMINATING A SURFACE OF A COMPONENT

(75) Inventor: Horst-Otto Bertholdt, Forchheim (DE)

(73) Assignee: Framatome ANP GmbH, Erlangen (DE)

( * ) Notice: Subject to any disclaimer, the term of this patent is extended or adjusted under 35 U.S.C. 154(b) by 0 days.

(21) Appl. No.: 09/854,260

(22) Filed: May 10, 2001

Related U.S. Application Data

(63) Continuation of application No. PCT/DE99/03489, filed on Nov. 2, 1999.

(30) Foreign Application Priority Data

Nov. 10, 1998 (DE) ..... 198 51 852

(51) Int. Cl.[7] ..... B05D 3/06
(52) U.S. Cl. ..... 427/558; 427/156; 427/343
(58) Field of Search ..... 427/553, 558, 427/343, 156

(56) References Cited

U.S. PATENT DOCUMENTS

| | | | | |
|---|---|---|---|---|
| 4,508,641 A | * | 4/1985 | Hanulik | 252/626 |
| 4,828,743 A | | 5/1989 | Rahfield | |
| 5,024,805 A | * | 6/1991 | Murray | 376/305 |
| 5,523,513 A | * | 6/1996 | Milner | 588/1 |
| 5,958,247 A | * | 9/1999 | Bertholdt et al. | 210/668 |

FOREIGN PATENT DOCUMENTS

| | | |
|---|---|---|
| CH | 653 466 A5 | 12/1985 |
| DE | 41 17 625 A1 | 12/1992 |
| DE | 41 17 625 C2 | 12/1992 |
| EP | 0 073 366 A2 | 3/1983 |
| EP | 0 278 256 A1 | 8/1988 |
| EP | 0 527 416 A2 | 2/1993 |
| EP | 0 527 416 B1 | 12/1996 |
| EP | 0 753 196 B1 | 9/1998 |
| JP | 62235490 | 10/1987 |
| JP | 07097694 | 4/1995 |

OTHER PUBLICATIONS

B. Bayri et al.: "Complexing properties of the main organic acids used in decontamination solutions for nuclear power plants and reactions involved in their degradation or elimination", Nuclear Engineering and Design , vol. 160, Feb. 1, 1996, pp. 159–170, XP–000893063, Elsevier Science S.A.

* cited by examiner

*Primary Examiner*—Michael Barr
(74) *Attorney, Agent, or Firm*—Laurence A. Greenberg; Werner H. Stemer; Gregory L. Maybeck

(57) ABSTRACT

A method for decontaminating a surface includes the steps of bringing a surface of a component formed of an unalloyed steel or a low-alloy steel into contact with a solution containing an oxalic acid for dissolving a contaminated layer from the component. Ions of divalent iron in the solution instantly form a protective layer on exposed surfaces. Iron (III) oxalate is converted into iron(II) oxalate and carbon dioxide by irradiation with UV light in order to provide ions of divalent iron. Subsequent to dissolving the contaminated layer, the protective layer is dissolved by lowering the level of the ions of the divalent iron in the solution. The ions of the divalent iron and the substance having caused the contaminated layer are bound to an ion exchange resin.

5 Claims, No Drawings

METHOD FOR DECONTAMINATING A SURFACE OF A COMPONENT

CROSS-REFERENCE TO RELATED APPLICATION

This application is a continuation of copending International Application No. PCT/DE99/03489, filed Nov. 2, 1999, which designated the United States.

BACKGROUND OF THE INVENTION

Field of the Invention

The invention relates to a method for decontaminating a surface of a component made from steel, in particular low-alloy steel or unalloyed steel. The surface of the component is brought into contact with a solution which contains oxalic acid and dissolves a contaminated layer from the base metal of the component.

A method of this type is described in Published European Patent Application No. EP 278 256. German Patent No. DE 41 17 625 C2 describes a method for decontaminating a component which may be formed of C-steel (carbon steel). The decontamination solution contains at least one organic acid. German Patent No. DE 41 17 625 C2 also states that it is possible to use oxalic acid for decontaminating surfaces. However, it is pointed out that oxalic acid is unsuitable, since it supposedly forms relatively insoluble precipitates with divalent iron.

It has been found that the base metal may be attacked or corroded during decontamination of low-alloy steel or unalloyed steel. When the base metal is attacked, then on the one hand the wall thickness of the component may be considerably reduced and on the other hand the quantity of radioactive waste which has to be disposed of may be increased.

It has hitherto not been possible to reduce the attack on the base metal by inhibition, since on the one hand available inhibitors would fail on account of the high process temperatures required and on the other hand the use of possible sulfur-containing inhibitors is not permitted in nuclear plants.

SUMMARY OF THE INVENTION

It is accordingly an object of the invention to provide a method for decontaminating a surface which overcomes the above-mentioned disadvantages of the heretofore-known methods of this general type and which minimizes the attack on the base metal in particular when the component is formed of low-alloy steel or unalloyed steel.

With the foregoing and other objects in view there is provided, in accordance with the invention, a method for decontaminating a surface, the method includes the steps of:

- bringing a surface of a component formed of a base metal selected from unalloyed steel or a low-alloy steel into contact with a solution containing an oxalic acid for dissolving a contaminated layer from the base metal of the component;
- providing ions of divalent iron in the solution for instantly forming a protective layer on just exposed portions of a base metal surface;
- converting iron(III) oxalate into iron(II) oxalate and carbon dioxide by irradiation with UV light;
- subsequent to dissolving the contaminated layer, dissolving the protective layer by lowering a level of the ions of the divalent iron in the solution; and
- binding ions of the divalent iron no longer required and a substance having caused the contaminated layer to an ion exchange resin.

In other words, the object of the invention is achieved by the fact that the oxalic-acid-containing solution with which the surface of the component is brought into contact also contains ions of divalent iron and as a result immediately forms a protective layer on parts of the base-metal surface which have just been exposed, in that iron(III) oxalate is converted into iron(II) oxalate and carbon dioxide by irradiation with UV light, in that after the dissolving of the contaminated layer has finished the protective layer is removed again by lowering the level of ions of divalent iron in the solution, and in that ions of divalent iron which are no longer required and the substance which caused the contamination are bound to an ion exchange resin.

The process according to the invention has the advantage that a protective layer is formed, which on the one hand protects the base metal from attack during the decontamination and on the other hand can easily be removed again at the end of the actual decontamination. There is advantageously no need for expensive inhibitors, so that for this reason alone, but also on account of substantially avoiding the attack on the base metal, the quantity of decontamination waste which has to be disposed of is minimized. If there is insufficient divalent iron present, it is possible, according to the invention, to obtain divalent iron from trivalent iron, by irradiating the solution, which contains ions of trivalent iron, with UV light. UV irradiation for the reduction of iron is described in European Patent No. EP 0 753 196 B1. However, the process disclosed in that document is not used for the decontamination of component surfaces, but rather to dispose of a decontamination solution which contains oxalic acid. For this purpose, in a circulating process iron(III) oxalate is converted into divalent iron oxalate and then back into the starting complex by UV irradiation. In the process, the oxalic acid is broken down to form $CO_2$ and water.

The ions of divalent iron (iron(II) ions) may also be added to the solution from the outside. An iron(II) salt is particularly suitable for this purpose.

According to another mode of the invention, the iron(II) ions can be dissolved out of the contaminated layer or out of the base metal. This causes only insignificant abrasion of base metal, since only a relatively small amount of iron(II) ions are used.

The addition and the dissolution of iron(II) ions can also be combined.

Both, after iron(II) ions have been fed into the solution and after iron(II) ions have been dissolved out of existing material (base metal, layer), a protective layer is immediately formed from the iron ions and an organic acid on decontaminated steel which has already been exposed. If the acid is oxalic acid, this protective layer includes iron(II) oxalate.

Depending on the type of power plant, it is also possible for both, ions of divalent iron and ions of trivalent iron to be dissolved out of the contaminated layer.

During the decontamination process, ions of divalent iron which are no longer required are bound to an ion exchange resin. Iron(II) ions which are still present in the solution at the end of the decontamination can also be disposed of using ion exchange resin.

In the most favorable case, only oxalic acid is required for the decontamination process, since the iron ions required can be obtained directly from the oxide layer which holds the contamination or they may be obtained from the base metal.

According to another mode of the invention, the oxalic acid is broken down into carbon dioxide by using UV light and hydrogen peroxide, when the oxalic acid is no longer needed.

To eliminate the waste, in addition to an ion exchange resin all that is required is hydrogen peroxide. At the end of the decontamination and the associated breakdown of the protective layer, all that then remains apart from the laden ion exchange resin is carbon dioxide.

The invention has the particular advantage that, in the case of decontamination on low-alloy or unalloyed steel, there is scarcely any attack or corrosion on the base metal yet nevertheless only small quantities of chemicals are required, and that very little waste which has to be disposed of remains.

A further advantage is that there is no need for sulfur compounds and also no need for any other expensive inhibitors and that nevertheless there is only an extremely slight attack on the base metal. There is no risk of selective corrosion (pitting).

Other features which are considered as characteristic for the invention are set forth in the appended claims.

Although the invention is illustrated and described herein as embodied in a method for decontaminating a surface, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments.

Based on an example, the individual chemical reactions which take place during the process according to the invention are listed below:

Initially, iron(II) oxalate and iron(III) oxalate are formed from oxalic acid and oxides of divalent and trivalent iron, which form part of the layer containing the contamination. Ions of divalent and trivalent iron are then present in solution.

The iron(III) oxalate (iron(III) ions) is converted into iron(II) oxalate (iron(II) ions) and carbon dioxide by irradiation with UV light. The iron(II) oxalate (iron(II) ions), as soon as there is a pure, oxide-free base metal surface as a result of the decontamination, forms a protective layer on that surface. Even while the decontamination is still proceeding at other locations, i.e. while iron oxides are still being dissolved by the acid, the protective layer accumulates at the locations which have already been cleaned.

Any excess of iron(II) oxalate (iron(II) ions) is bound to an ion exchange resin (cation exchange resin), with oxalic acid being released again.

As soon as the decontamination has ended, i.e. when all the iron oxides have been dissolved from the surface, no further iron oxalate is formed. Then, the protective layer of iron(II) oxalate which is no longer required is advantageously broken down or dissolved in the solution, i.e. the iron(II) oxalate of the protective layer is dissolved and then, as has previously been the case for any excess oxalate, is bound in an ion exchange resin, releasing oxalic acid. Then, apart from the laden ion exchange resin, all that remains is oxalic acid. This oxalic acid is broken down to form carbon dioxide by the addition of hydrogen peroxide in combination with UV light. Apart from ion exchange resin, only carbon dioxide remains.

I claim:

1. A method for decontaminating a surface, the method which comprises:

bringing a surface of a component formed of a base metal selected from the group consisting of an unalloyed steel and a low-alloy steel into contact with a solution containing an oxalic acid and dissolving a contaminated layer from the base metal of the component for providing an exposed base metal surface;

providing ions of divalent iron in the solution for instantly forming a protective layer on the exposed base metal surface;

converting iron(III) oxalate into iron(II) oxalate and carbon dioxide by irradiation with UV light;

subsequent to dissolving the contaminated layer, dissolving the protective layer by lowering a level of the ions of the divalent iron in the solution; and binding ions of the divalent iron no longer required for forming a protective layer on the exposed base metal surface and a substance having caused the contaminated layer to an ion exchange resin.

2. The method according to claim 1, which comprises adding ions of divalent iron to the solution.

3. The method according to claim 1, which comprises dissolving ions of divalent iron out of the contaminated layer.

4. The method according to claim 1, which comprises dissolving ions of divalent iron out of the base metal.

5. The method according to claim 1, which comprises breaking down the oxalic acid into carbon dioxide by using UV light and hydrogen peroxide, when the oxalic acid is no longer needed for dissolving the contaminated layer from the base metal of the component.

* * * * *